United States Patent [19]

Walbrun

[11] 4,284,465

[45] Aug. 18, 1981

[54] APPARATUS FOR THE MANUFACTURE OF FIBROUS SHEET STRUCTURE

[75] Inventor: Lawrence A. Walbrun, Menasha, Wis.

[73] Assignee: American Can Company, Greenwich, Conn.

[21] Appl. No.: 101,994

[22] Filed: Dec. 7, 1979

Related U.S. Application Data

[62] Division of Ser. No. 950,076, Oct. 10, 1978, abandoned.

[51] Int. Cl.[3] ..... B30B 3/00; B31F 1/10

[52] U.S. Cl. ..... 156/513; 29/121.1; 29/121.6; 156/209; 156/516; 156/548; 156/549; 156/553; 156/555; 156/582; 428/166

[58] Field of Search ..... 156/553, 555, 582, 462, 156/209, 547, 513, 548, 549; 428/154, 535, 298; 29/121.1, 121.2, 121.5, 121.6, 121.7

[56] References Cited

U.S. PATENT DOCUMENTS

| | | | |
|---|---|---|---|
| 3,556,907 | 1/1971 | Nystrand | 156/209 |
| 3,868,205 | 2/1975 | Thomas | 156/555 |
| 4,105,491 | 8/1978 | Haase et al. | 156/553 |

*Primary Examiner*—Paul J. Thibodeau

*Attorney, Agent, or Firm*—Robert P. Auber; George P. Ziehmer; Harry W. Hargis, III

[57] ABSTRACT

An apparatus for fabricating absorbent, puffy sheet structure comprising a pair of plies of web material adhered in continuous linear regions interspersed with pocket portions. Portions of the plies forming the pocket portions include inwardly presented perforate bosses that enhance softness and water absorbency. The apparatus comprises a pair of matched-pattern, synchronously rotatable steel rolls each provided with small, sharp, ply-perforating members in the recesses between land areas, in combination with synchronous rotatable rubber embossing rolls urged against the rotatable steel rolls and intervening plies to form the perforate bosses.

3 Claims, 4 Drawing Figures

APPARATUS FOR THE MANUFACTURE OF FIBROUS SHEET STRUCTURE

This is a division of application Ser. No. 950,076, filed Oct. 10, 1978, now abandoned.

BACKGROUND OF THE INVENTION

This invention relates to improvements in apparatus for the fabrication of multi-ply fibrous sheet structure, particularly of the soft absorbent type, such as, for example, paper towels.

In the fabrication of paper towels, efforts have been directed to improving the water holding capacity thereof involving, for example, such techniques as creping, puffing, perforating and the like to increase the surface area of the towel. Perforating has generally been effected using prior art embossing techniques in which pins are pushed through from one side of a web to leave outwardly extending projections of fibers on an exposed surface of the web.

The following U.S. patents are representative of the prior art, and are believed material to the Examination of this application:

U.S. Pat. No. 2,281,945 discloses perforation of a multi-ply sheet A to form a plurality of small tufts or mounds B projecting away from surfaces of the sheet to enhance its cleansing action.

U.S. Pat. No. 3,323,983 discloses apparatus for embossing superposed paper plies 14 between embossing rolls 10, 11 provided with mating pegs 12, 13.

U.S. Pat. No. 3,546,056 discloses a sheet comprising plies of wadding 4, 5 on each side of an open mesh scrim 1. Pin embossments 25 project from one side of the sheet in provision of a roughened surface of improved cleansing action.

It is a general objective of the invention to provide apparatus for fabricating a multi-ply sheet structure of improved absorbency and softness.

SUMMARY OF THE INVENTION

In achievement of the foregoing as well as other objectives and advantages, the invention contemplates an apparatus for the fabrication of a multi-ply fibrous sheet structure, comprising: a first pair of embossing rolls of substantially rigid material including matched patterns having recessed sections and continuous linear, radially outwardly presented land regions disposed thereabout; a plurality of radially outwardly presented, sharp protuberances in said recessed sections; means mounting said first pair of embossing rolls for rotation about parallel axes and in tangential, nip forming engagement with one another; a second pair of embossing rolls of substantially flexible and resilient material mounted for rotation about axes parallel with the recited axes of said first pair of embossing rolls, and disposed in forcible, tangential, nip-forming engagement therewith; means for feeding a pair of fibrous webs through said nips between said first and second pair of embossing rolls so that said webs are resiliently urged by said second pair of rolls into engagement with the pattern on said first pair of rolls, engagement with said land regions being effective to form flat continuous linear sections, and engagement with said recessed regions and protuberances therein being effective to form pocket portions and perforations therein surrounded by fibers presented inwardly of said pocket portions; means for applying adhesive to the linear section of at least one of said webs, and said first pair of rolls being operable upon rotation thereof to convey said webs through the recited nip thereof for adherence of said flat regions of the webs in formation of the recited multi-ply sheet, and for removal of the latter from said nip.

DESCRIPTION OF THE PREFERRED EMBODIMENT

Figure 1:
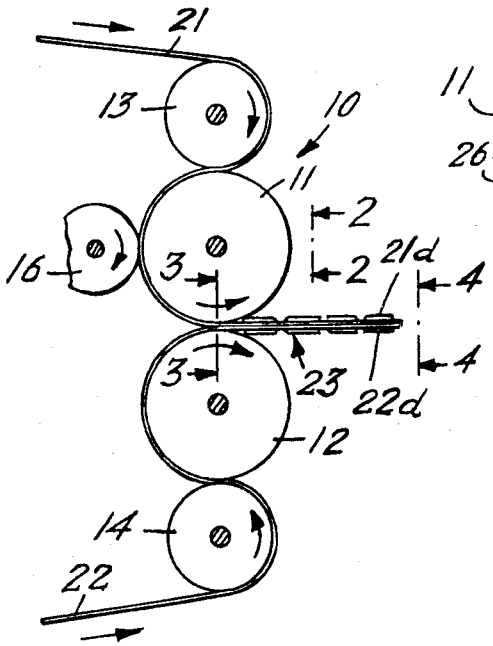
FIG. 1 is a diagrammatic elevational showing of the apparatus contemplated by the invention.

With more detailed reference to the drawing, and first to FIG. 1, an apparatus 10 includes a pair of embossing rolls 11 and 12 made of substantially rigid material, such as steel, provided with matching patterns to be described in detail in what follows. Rolls 11 and 12 are of like diameters, are mounted for rotation about parallel axes, by suitable drive means of conventional construction, and are so cooperably disposed as to form a ply bonding nip.

A pair of embossing rolls 13 and 14 made of substantially flexible and resilient material, such as rubber, are mounted for rotation about parallel axes by known suitable drive means, and are so cooperably disposed as respects steel rolls 11 and 12 respectively, to form embossing nips therewith.

A pair of webs 21 and 22 of paper, for example creped coarse fiber stock such as is used in paper toweling, are fed from suitably arranged supply rolls (not shown) over rubber rolls 13 and 14, respectively. Web 21 then is fed between rolls 11 and 13, while web 22 is fed between rolls 12 and 14, and by this feed there is formed in each web the matching embossed patterns of rolls 11 and 12. An adhesive applicator device of conventional construction includes an applicator roll 16 disposed for tangential engagement with web 21 on embossing roll 11. As web 21 is fed past applicator roll 16, adhesive is applied to land areas thereof, also to be described in what follows, and continued rotation of the rolls drives webs 21 and 22 into the ply bonding nip of rolls 11 and 12, from which the bonded webs exit as a finished, multi-ply sheet structure 23 of improved absorbency and puffiness.

Figure 2:
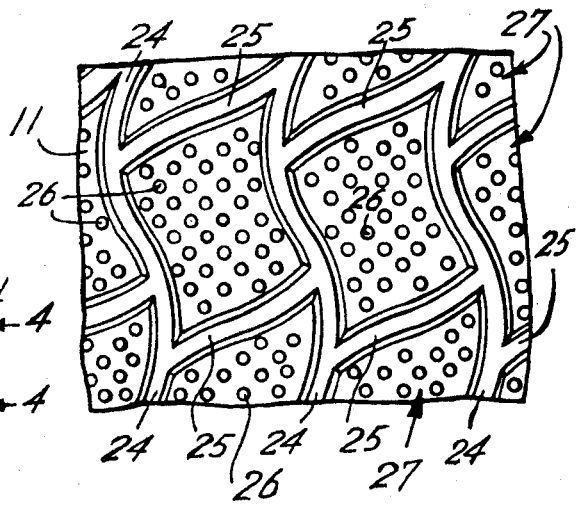
FIG. 2 is an enlarged, fragmented elevational view of the apparatus in FIG. 1, looking in the direction of arrows 2—2 applied thereto.
Figure 3:
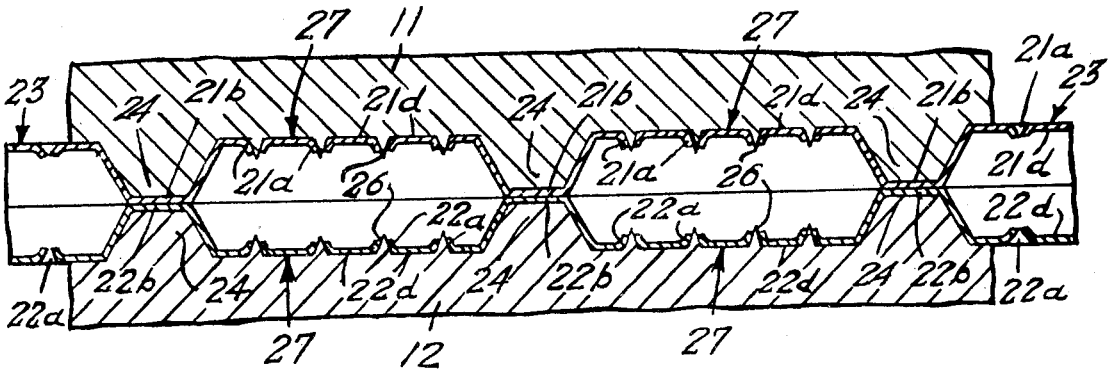
FIG. 3 is a fragmented sectional view of the apparatus and product taken in the plane of line 3—3 in FIG. 1, and looking in the direction of arrows applied thereto.

Turning to FIGS. 2 and 3 in particular accordance with the improvements contemplated by the invention, embossing patterns on roll 11 comprise generally circumferentially extending, radially outwardly presented land regions 24 between which are disposed generally axially extending, intersecting radially outwardly presented land regions 25. These, radially outwardly presented land regions 24 and 25 are therefore of substantially continuous linear extent, in a generally quadrilateral configuration, and are thus so cooperably disposed as to form recessed sections 27. The bottom surfaces of recessed sections 27 are provided with a plurality of sharp radially outwardly presented protuberances 26.

It will be understood that in view of the identical structure of patterned rolls 11 and 12, and as is seen in FIG. 3, the same reference numerals 24, 25, 26, and 27 have been applied thereto.

Rubber rolls 13 and 14 are of such flexibility and resiliency that when urged against a corresponding steel roll, and an intervening web 21 or 22, respective portions 21*d* and 22*d* of the webs are urged into the recessed sections 27 with sufficient force to form pocket portions or bosses in the webs, and further to cause these same web portions to be pierced by relatively sharp protuberances 26, forming a relatively fine emboss pattern including perforations designated generally by numerals 21*a*, 22*a* in FIG. 3. Under the same urging by the rubber rolls 13 and 14 the land regions 24 and 25 cooperate therewith to form flat regions 21*b*, 22*b* in the webs. It will be appreciated that perforation of each web is aided by stretching of the material thereof in its weaker, cross-machine direction as it is urged into each recessed section 27.

It is to be appreciated that: the distance between mating lands 24, 25 of rolls 11 and 12 is slightly less than the combined thicknesses of webs 21 and 22; the distance between the surface of a land 24, 25 and the bottom surface of a recessed section 27 is greater than the thickness of a web 21 or 22; and the height of a member 26 is less than the aforesaid distance, but is of course sufficient to perforate a web 21 or 22 urged thereagainst by a roller 13 or 14. By such construction, the protuberances 26 are of lesser radial extent than the lands 24 and 25.

In operation of the apparatus, adhesive is applied to the flat regions 21*b* of upper web 21 as it is moved past adhesive applicator roll 16. Continued rotation of the rolls 11, 12, 13 and 14 feeds embossed webs 21 and 22 into the nip of rollers 11 and 12, as is seen in FIG. 3, where the flat regions 21*b* and 22*b* of the respective webs are adhered to one another and exit from the apparatus 10 as a finished sheet 23.

Figure 4:
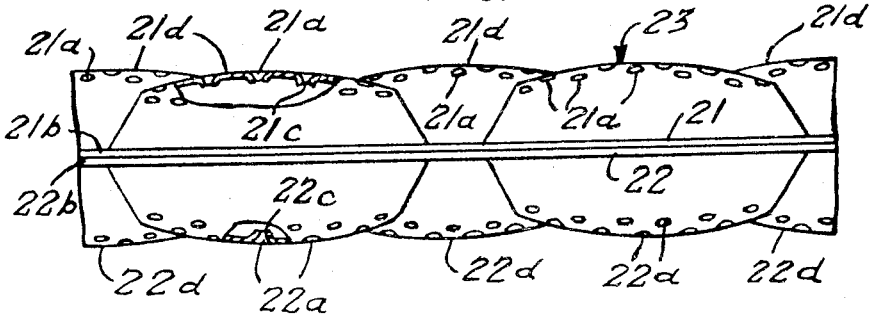
FIG. 4 is a fragmented elevational view, partly in section, of the product fabricated by the apparatus seen in FIG. 1, and looking in the direction of arrows 4—4 applied thereto.

As is best seen in FIG. 4, the finished sheet 23 is of puffy construction, as is afforded by the formation of the outwardly presented pocket portions or bosses 21*d*, 22*d* taken with slight stretching thereof as the webs are disengaged from member 26, and is rendered highly absorbent by presence of inwardly projecting, mutually confronting fibers 21*c* and 22*c* disposed about and created in the formulation of perforations 21*a* and 22*a* by members 26. The sheet 23 further is rendered soft to the touch, by virtue of the inward projection of the fibers, wherein fibers of one ply are presented generally toward the fibers of another ply.

It will be appreciated from the foregoing that the invention is characterized by improvements in apparatus for the fabrication of paper toweling, and that the invention is susceptible of modifications without departing from the scope of the appended claims.

I claim:

1. An apparatus for the fabrication of a multi-ply fibrous sheet structure, comprising: a first pair of embossing rolls of substantially rigid material including matched patterns having recessed sections and continuous linear, radially outwardly presented land regions disposed thereabout; a plurality of radially outwardly presented, sharp protuberances in said recessed sections; means mounting said first pair of embossing rolls for rotation about parallel axes and in tangential, nip forming engagement with one another; a second pair of embossing rolls of substantially flexible and resilient material mounted for rotation about axes parallel with the recited axes of said first pair of embossing rolls, and disposed in forcible, tangential, nip-forming engagement therewith; means for feeding a pair of fibrous webs through said nips between said first and second pair of embossing rolls so that said webs are resiliently urged by said second pair of rolls into engagement with the pattern on said first pair of rolls, engagement with said land regions being effective to form flat continuous linear sections, and engagement with said protuberances and recessed regions being effective to form pocket portions and perforations therein surrounded by fibers presented inwardly of said pocket portions; means for applying adhesive to the linear section of at least one of said webs; and said first pair of rolls being operable upon rotation thereof to convey said webs through the recited nip thereof for adherence of said flat regions of the webs in formation of the recited multi-ply sheet, and for removal of the latter from said nip.

2. Apparatus of claim 1, wherein said land regions are disposed in intersecting, generally axially and generally circumferentially extending array on the surfaces of said first pair of rolls.

3. Apparatus of claim 1, wherein said radially presented protuberances are of lesser radial extent than said radially presented land regions.

* * * * *